US006754936B2

(12) United States Patent
Ereñaga

(10) Patent No.: US 6,754,936 B2
(45) Date of Patent: Jun. 29, 2004

(54) EXCHANGEABLE HANDLE FOR THE HANDLES OF MONKEY WRENCHES

(75) Inventor: Ignacio Aguirre Ereñaga, Deba (ES)

(73) Assignee: Irega, S.A., Vitoria (ES)

( * ) Notice: Subject to any disclaimer, the term of this patent is extended or adjusted under 35 U.S.C. 154(b) by 0 days.

(21) Appl. No.: 10/048,760

(22) PCT Filed: Jun. 6, 2001

(86) PCT No.: PCT/ES01/00233

§ 371 (c)(1),
(2), (4) Date: Feb. 1, 2002

(87) PCT Pub. No.: WO01/94081

PCT Pub. Date: Dec. 13, 2001

(65) Prior Publication Data

US 2002/0104194 A1 Aug. 8, 2002

(30) Foreign Application Priority Data

Jun. 7, 2000 (ES) ..... 200001437
Jan. 29, 2001 (ES) ..... 200100191

(51) Int. Cl.[7] ..... A47B 95/02
(52) U.S. Cl. ..... 16/430; 16/110.1
(58) Field of Search ..... 16/430, 110.1, 16/111.1, 422, 421; 7/167; 81/177.1

(56) References Cited

U.S. PATENT DOCUMENTS 2,467,284 A * 4/1949 Williams ..... 16/110.1
3,018,497 A * 1/1962 Echikson ..... 15/143.1
3,697,110 A * 10/1972 Portz et al. ..... 294/57
5,008,970 A * 4/1991 Tsai ..... 15/236.01
5,056,381 A * 10/1991 Carmein ..... 76/103
5,579,556 A * 12/1996 Chung ..... 16/110.1
5,622,445 A * 4/1997 Gou ..... 403/375
5,926,911 A * 7/1999 Chen ..... 16/111.1
5,956,799 A * 9/1999 Panaccione et al. ..... 15/236.01
6,182,538 B1 * 2/2001 Chen ..... 81/177.1
6,237,193 B1 * 5/2001 Skerker et al. ..... 16/430
D447,678 S * 9/2001 Staton et al. ..... D8/107

* cited by examiner

*Primary Examiner*—Lynne H. Browne
*Assistant Examiner*—Michael J. Kyle
(74) *Attorney, Agent, or Firm*—Klauber & Jackson

(57) ABSTRACT

A replaceable grip for a handle of an adjustable spanner with a hole for hanging (26) which comprises a body **(1*a*) made of an at least semi-elastic material adapted internally to at least a part of the section of the handle (23) and means of securing (2,15,16,24,24',25) to fix the body (1*a*) to the handle (23), the body (1*a*) of the grip (1,1') comprising a through-hole (20) in a position coincident with the hole for hanging (26) of the handle (23), an internal axial void (1*b*) with a double-"T" cross section adapted to the cross section of the handle (23) at different points of the contour of the handle (23), while the first means of securing (2,15,16,24, 24',25) each comprise flat blocking elements (2,9,24,24,", 24'") which cover at least opposing edges of said through-hole (20), securing means (15,16,25) which penetrate into the through-hole (20) tightening the blocking elements (2,9, 24,24,",24'") against the grip (1,1')**.

21 Claims, 15 Drawing Sheets

A-A

B-B

C-C

D-D

E-E

F-F

H-H

J-J

K-K

L-L

EXCHANGEABLE HANDLE FOR THE HANDLES OF MONKEY WRENCHES

TECHNICAL FIELD OF THE INVENTION

The present invention pertains to the sector of the replaceable grips for handles of spanners, particularly for handles of adjustable spanners.

BACKGROUND OF THE INVENTION

Fixed and adjustable spanners are well known which incorporate a grip on the handle, generally made of rubber or plastic material, in order to provide a holding surface with a high coefficient of friction with the user's hand. The grip normally covers a part of the handle, from an area close to the head of the spanner to another area close to the end of the handle, or else, covers the handle from an area close to the head to the end of the handle. In this last case the grip also includes the hole which the metal handle generally has at its end and which is employed for hanging up the spanner when not being used.

In any case, the grip must have a design or shape with ergonomic characteristics in order that it may be used in a simple manner and may be grasped appropriately, adapting to the different positions of the hand.

For the adapting and securing of the grip on the handle, it has been foreseen, according to a known solution, that the handle has a lowered transversal section, from an area close to the head of the spanner to an area close to the end of the spanner. On this lowered area of the handle the grip is inserted or coupled and is secured longitudinally by the stops that the end walls of said recessed area define. Securing against twisting effects can be achieved by the application of an adhesive.

The most important drawback of this type of spanners is that the spanner cannot be employed without its grip. In the event that the latter becomes worn down through use, or for whatever accidental circumstance (for example, the spanner is dropped on the floor or deformation from being too close to a source of high temperature), the spanner cannot be employed adequately because the handle has, over almost all its length, a lowered area making holding uncomfortable and not functional in comparison with the traditional or ergonomic handles which do not have said lowered area.

On the other hand, there is a part of the handle, specifically the end thereof, which is not covered by the grip, whereby the holding characteristics are diminished precisely in the area that the user tends to grasp in order to be able to apply a greater operating force with the spanner.

A second solution known consists in that the handle, contrary to the previous case, has no lowering, and the grip is placed over the handle from an area close to the head of the spanner to an area close to the end of the handle. In this case the securing of the grip to the handle, in order to withstand longitudinal and twisting effects is achieved by means of an adhesive.

In this second solution the above mentioned drawbacks remain with regard to the grasping conditions, since the end of the handle is not covered by the grip. Even though the spanner can be used without the grip, the user must proceed to dismantle the grip and to adapt the handle, by means of operations which are neither quick nor simple. It is to be borne in mind that the grip is joined to the handle by means of an adhesive and the separation therefore must be carried out against the force of adherence of the adhesive and, subsequently, the layer of adhesive covering the handle shall have to be eliminated.

A third solution known consists in that the handle has a lowered transversal section from an area close the head of the spanner to the opposite end inclusive, that is in its entirety, since the grip is placed on top of the handle covering also the end thereof. The securing of the grip to the handle in order to withstand the longitudinal and twisting forces is achieved by means of an adhesive.

In this third case the drawbacks of the first solution are further accentuated, insomuch as the spanner cannot be employed without its grip, since in this third case the handle has the lowered area over its full length, making holding uncomfortable and not functional in comparison with the traditional or ergonomic handles which do not have that lowered area. Additionally, the dismantling of the grip presents the problems described in relation with the second solution.

Finally, a fourth solution known consists in that the handle of the spanner is of a traditional or ergonomic shape and the grip is placed on top of the handle from the area close to the head to the opposite end thereof inclusive, that is, on its entirety, and is adapted to the shape of the handle, handle and grip being joined by means of an adhesive material.

In this fourth case, when the grip is detached or loosened from the handle or this becomes worn down, the user can employ the spanner without a grip without difficulty, given that it does not have a lowering and has a traditional or ergonomic shape, but however replacement of the grip is not foreseen and in any case, the replacement, which involves both the dismantling of the grip and the mounting of the new grip, cannot be carried out by the user in a quick and simple manner.

DESCRIPTION OF THE INVENTION

The present invention is intended to overcome the drawbacks of the state of the art by means of a replaceable grip for spanner handles, particularly for handles of adjustable spanners, which offers a high coefficient of friction by being of a thermoplastic material, rubber or similar, which fits tightly over the outline of the metallic handle, wrapping round its end and such that this hole for hanging is covered and free and that it is easy to replace.

Thus, the present invention relates to a replaceable grip for a spanner handle, particularly that of an adjustable spanner, with a handle with a first end provided with a hole for hanging, the grip comprising a body open at one of its ends, of a material at least semi-elastic selected from among plastic materials, thermoplastic materials and rubbers, adapted internally at least to part of the section of the handle, and means of securing to secure the body of the handle, characterised in that

- the body of the grip comprises,
  - a through-hole in a position coincident with the handle hole for hanging,
  - a blind internal axial void with a double-"T" cross section adapted to the cross section of the handle at different points of the handle contour,
- the first means of securing comprise
  - flat blocking elements that each cover at least opposite rims of said through-hole,
  - means of securing which penetrate into the through-hole tightening the blocking elements against the grip.

According to the invention, the blocking elements can be joined to the grip by means of an adhesive and, preferentially, the blocking elements are each mounted in axial recesses provided on each side of the body, the through-hole being arranged in said recesses in such a manner that, preferentially, the exposed faces of the blocking means, are flush with the rest of the grip surface, providing continuity for the primary ergonomic form.

According to an embodiment of the invention at least one of the blocking elements, though preferably both, is a blocking plate arranged axially on the handle. Such blocking plates permit the grip to reach a resistance, being reached precisely through the stiffness of the plates which constitute a reinforcement of the material of the grip, and their securing of the grip can be optimised by the application of an adhesive in the recesses in order that the plates are stuck to the grip.

On the other hand, according to another embodiment, combinable with the embodiment in which only one of the blocking elements is a blocking plate, at least one of the blocking elements is an outer edge of a socket.

Furthermore, and according to another embodiment of the invention, combinable with any of the embodiments described above, at least one of the blocking elements is a blocking washer.

The blocking elements against the grip can comprise a male socket and a female socket coupled to each other in the hole for hanging. According to this embodiment, one or the two male and female sockets can be independent elements or emerge from one of the blocking plates, as for example from a male plate from which emerges the male socket and a female plate from which emerges the female socket. In this embodiment the sockets can each have free rims with male-female interconnection means, whilst at their other end they can be provided with thickenings which fit in the hole for hanging of the spanner handle.

In another embodiment of the invention, at least one of the blocking elements against the grip is a socket which emerges from a blocking plate, the socket being retained in the hole for hanging by pressure. This form of embodiment avoids an elastic coupling and a direct contact between plastic elements (the plates) and the metal handle of the spanner, thereby preventing certain frictions, vibrations and noises during handling by the user, and the subsequent sensation that something is coming loose on the inside of the grip. In this case the sockets are not of the male and female type and consequently are not intended to be interconnected, but both plates are identical, flat and each has only one socket preferentially short in length which are inserted into the openings of the through-hole of the grip and so into the hole for hanging of the spanner, with the particularity that they do not manage to establish contact with each other though both penetrate to an equal extent into the hole in the core of the spanner, being maintained in an intermediate coaxial position annular rings as a prolongation of the rims of the holes of the grip, on their inside faces, which are also introduced into said hole.

The securing of the grip in this case is established by the actual pressure of the plates in the recesses (by manufacturing tolerances) and also by the sockets thereof. It is possible to improve the blocking action by foreseeing that the edges of the plates and the walls of the recipient recesses, are slightly oblique (wider in the bottom) in order to present an interlocking edge in the flexible material of the grip.

In addition to the means of securing and the blocking elements, the plates may be joined to each other also by male-female elements passing through one or more supplementary holes provided in the handle of the spanner. Also in this embodiment, one of the blocking plates can be a male plate of elongated shape which incorporates at least one peg with diametric cuts which form flexible arms passing through an additional hole of the grip and through the additional hole in the handle of the spanner. Such male plate can be combined with a female plate which has on its inside face at least one projection provided with a recipient hole to receive the elastic arms of the male plate. The projection can be in the form of a bridge with legs joined to the plate.

These plates once mounted on the respective face of the grip, can be firmly integral to each other by supplementary means of axial support, with which the elastic arms of the male plate are extended. To achieve said extension, the supplementary means of axial support can comprise a solid pin housed in an axial void of the peg, the pin extending the flexible arms. Such pegs are preferentially tubular with an axial void open to the outside of the plate from which they rise. Through this respective hole a smooth shaft is introduced under pressure, said shaft having been advantageously formed in the same process as for obtaining the male plate, by injection into a mould, standing on the other side of the plate and which on being struck slightly breaks the join along an annular line of easy detachment, being totally inserted thereinafter until its outer end is flush with the plate, thus contributing to the good appearance of the assembly since the hole is thereby closed. In turn the solid pin can emerge from the male plate or be an independent element. In this embodiment the free edge of the male and female plates can have a perimetric skirt which defines a lip which is introduced in a channel on the bottom of the longitudinal recess of the grip.

As is conventionally encountered in the type of grip, also the grip of the present invention can have on its edges and/or on its sides, ribs and/or protuberances serving a non-slip function.

BRIEF DESCRIPTION OF THE DRAWINGS

To facilitate in a better understanding of the characteristics of the invention and forming an integral part of this description, a number of drawings are attached in which.

DESCRIPTION OF AN EMBODIMENT OF THE INVENTION

Figure 1:
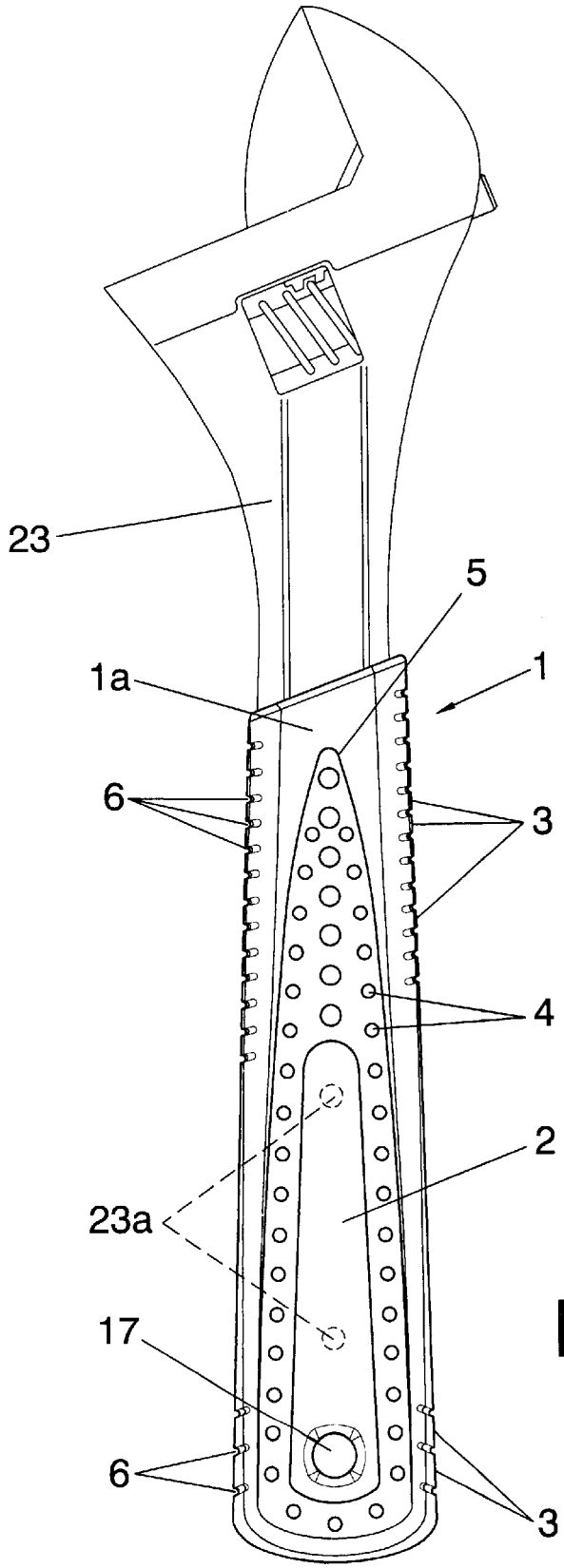
FIG. 1 shows a plan view of an adjustable spanner which incorporates on its handle a replaceable grip in accordance with the present invention.

With reference to the numbering scheme adopted for the FIGS. 1 to 25, it can be seen how the replaceable grip 1 with a body 1*a*, covers the handle 23 of an adjustable spanner from its end up to an area close to the start of the head of the spanner, as may be observed in FIG. 1. The reference 2 in this figure designates the plate securing the grip to the handle, visible from this side and specifically that which has been designated as female plate. The edges of the grip 1 include a plurality of ribs 3 which optimise the grasp, there also being other spherical protuberances 4 on the larger faces, and other embellishing channels 5 and with which slipping of the spanner is also avoided.

Figure 2:
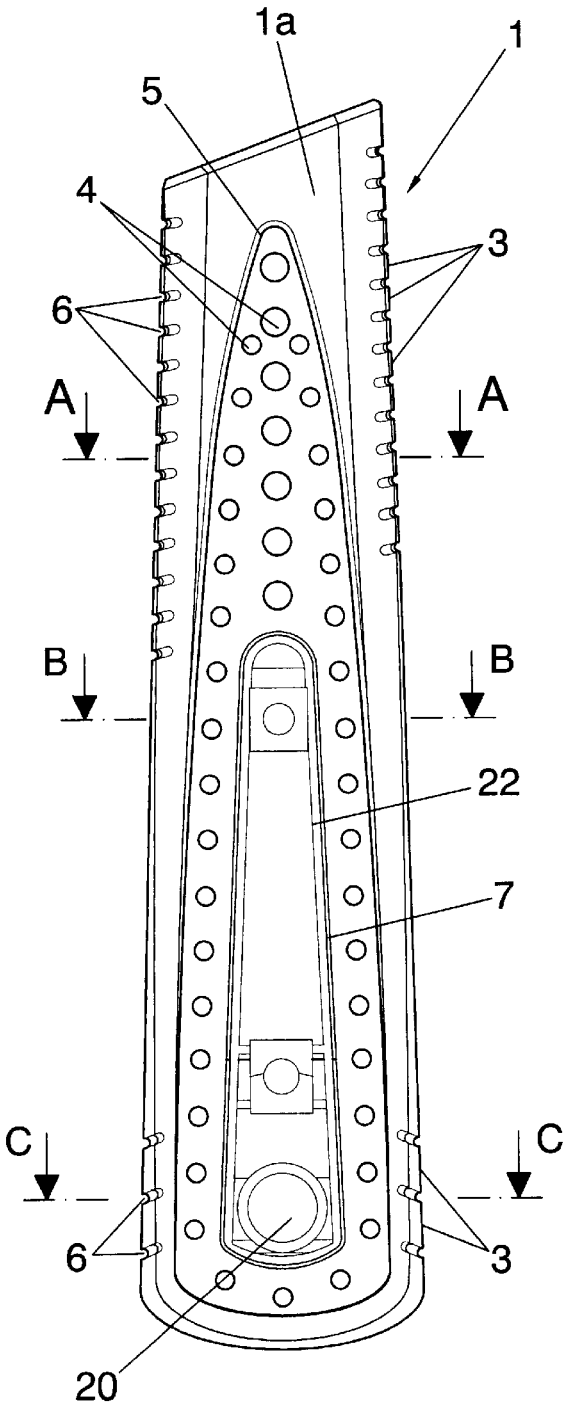
FIG. 2 shows a plan view of the same grip as FIG. 1, without including the securing plate, to permit to be observed the housing implemented in the grip for the seating thereof.
Figure 3:
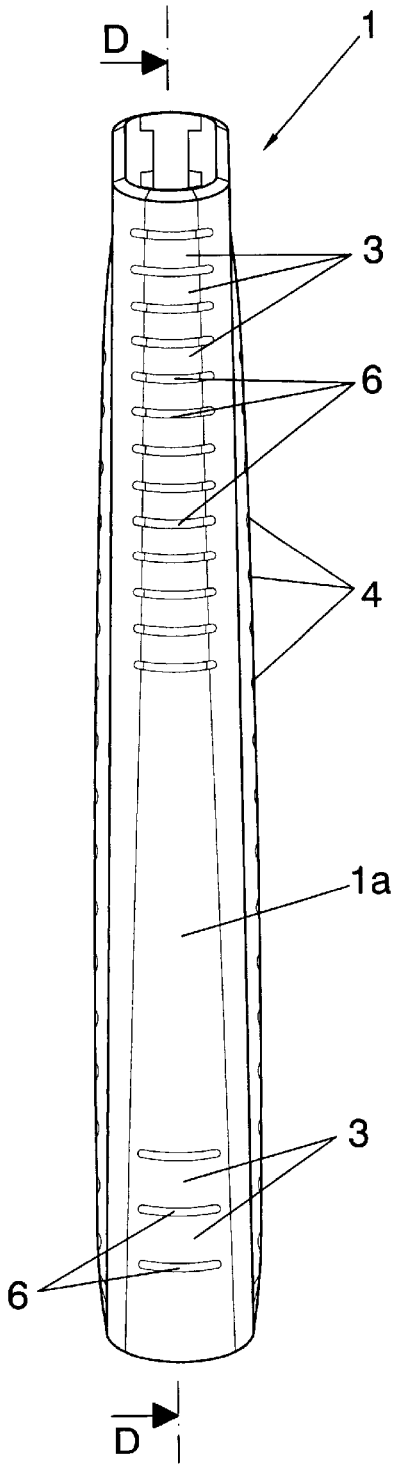
FIG. 3 shows a side elevation of that shown in FIG. 2.

In FIGS. 2 and 3 it can be seen how, through the presence of a plurality of parallel grooves 6, transversal ribs 3 are formed close to each other. On the longitudinal centre line of one of the faces of the grip 1 there is a recess 7 in which is housed the female plate 2 the geometry of which can be observed in FIGS. 19 to 25.

Figure 4:
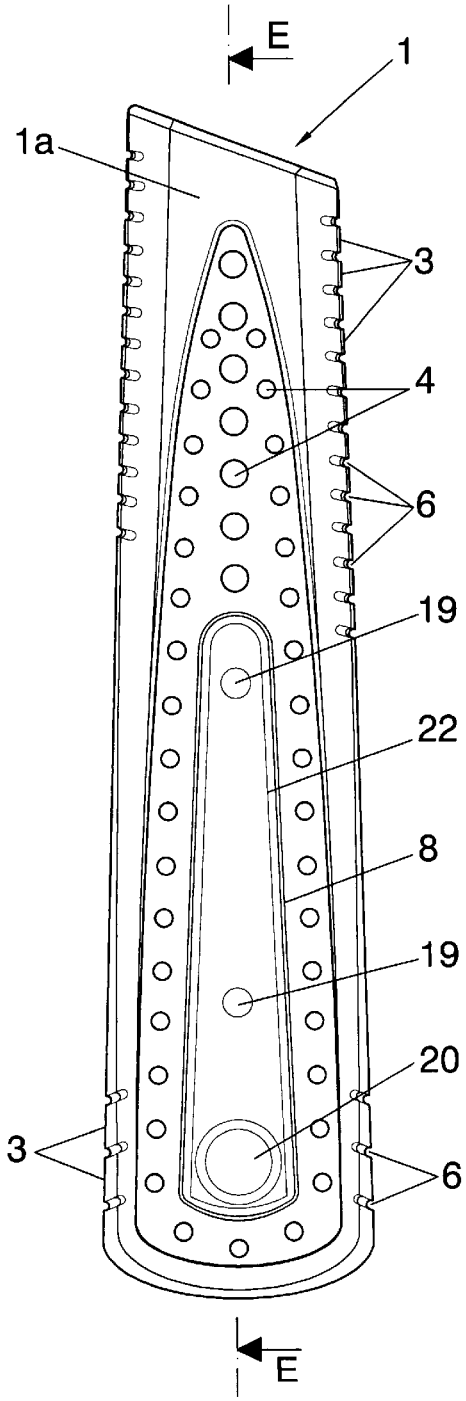
FIG. 4 shows a plan view, from the opposite side of the grip, without including the securing plate, the same as that stated regarding FIG. 2.

In FIG. 4 is shown the other face of the grip 1. In the longitudinal recess 8 the contour of which is advantageously identical to the recess 7 of the opposing face, shall be lodged the male securing plate 9 whose geometry can be observed in FIGS. 12 to 18.

Figure 5:
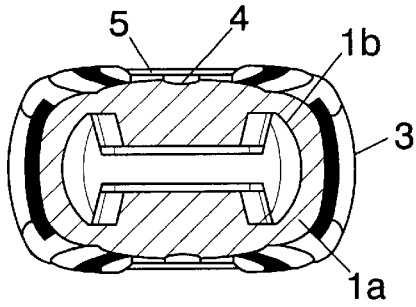
FIG. 5 shows a cross section on the line A—A of FIG. 2.
Figure 6:
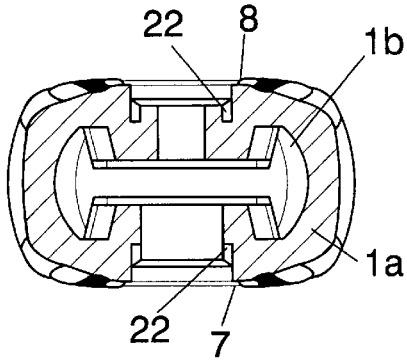
FIG. 6 shows a cross section on the line B—B of FIG. 2.
Figure 7:
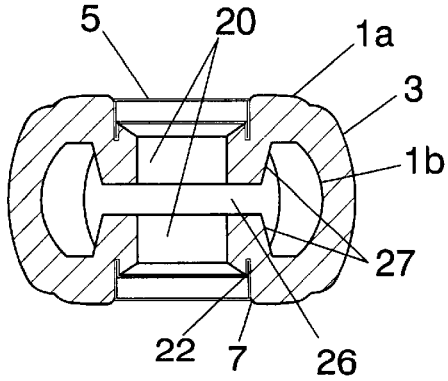
FIG. 7 shows a cross section on the line C—C of FIG. 2.

The body of the grip 1 has an axial void 1*b* with a cross section internally adapted to the cross section presented by the metal handle of the adjustable spanner, this being in the form of a double-tee as is deduced from examining FIGS. 5 to 7.

The male plate 9 has on its inside face the nipples or pegs 10 which traverse the web of the metal handle, emerging on the other side to be inserted in the projections 11 provided on the inside face of the female plate 2 and which incorporate respective recipient holes 12 of diameter adapted to that of the pegs 10.

The male 9 and female 2 plates fit perfectly into the respective housings defined by the recesses 8 and 7, not overshooting on the outside in order to contribute to the good appearance of the grip 1.

The outside face of the male plate 9 includes the solid pins 13 which when inserted into the inside of the pegs 10 separate the flexible arms 14 radially in order to achieve perfect fastening to the female plate 2.

The male 9 and female 2 securing plates each also include in the area in which is to be found the common hole for hanging which is a feature of that type of adjustable spanner, sockets 15 and 16, the free edges of which are machined in order to permit a dovetailed connection, when both securing plate 9 and 2 are mounted. The axial void 17 of these sockets 15 and 16 is open to the exterior in order to constitute the hole (see FIG. 1) from which the spanner is hung.

Figure 8:
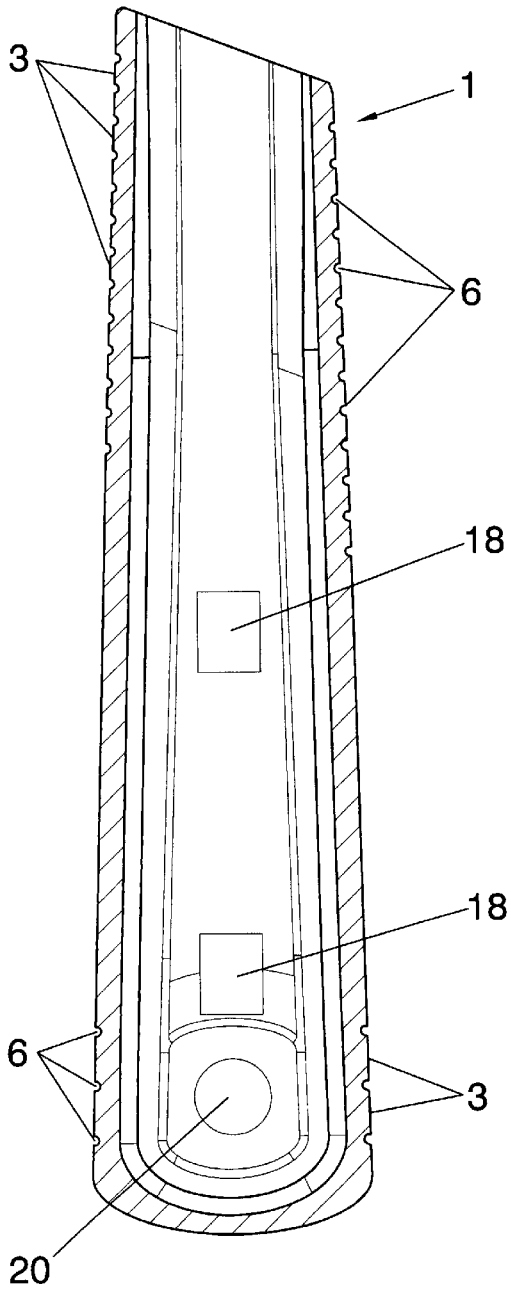
FIG. 8 shows a cross section on the line D—D of FIG. 3.
Figure 9:
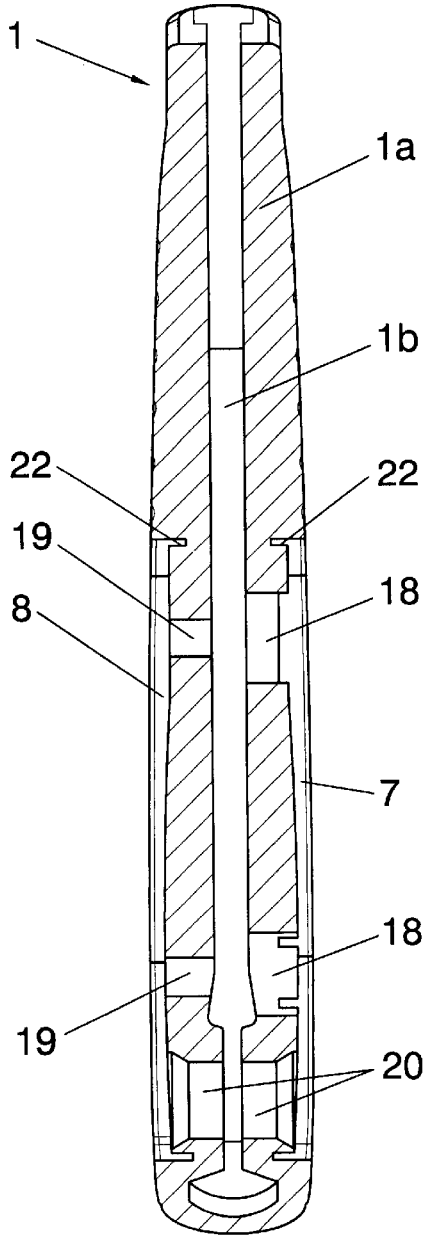
FIG. 9 shows a cross section on the line E—E of FIG. 4.
Figure 10:
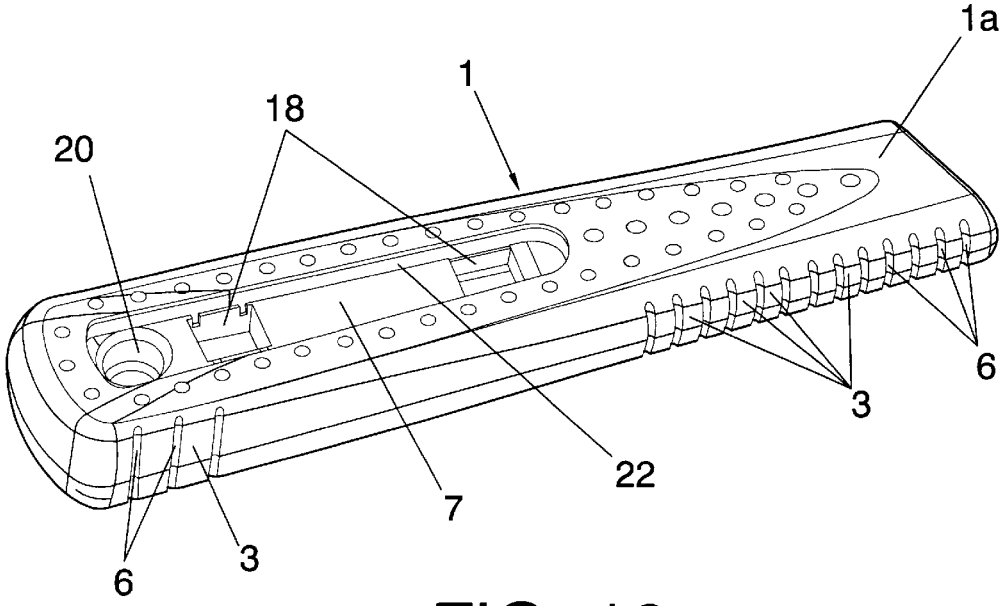
FIG. 10 shows a view in perspective of the grip, from the side on which the female plate is visible, without this being included.
Figure 11:
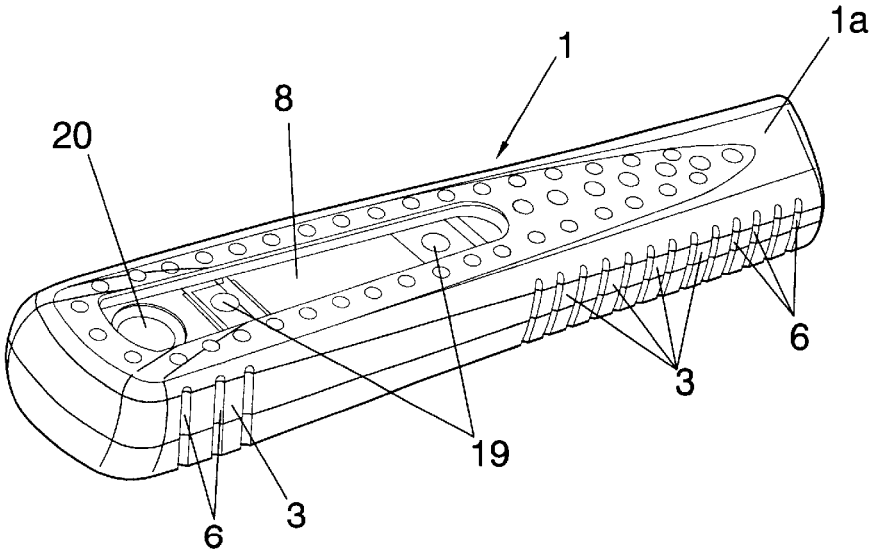
FIG. 11 shows a view similar to FIG. 10, from the other side.
Figure 12:
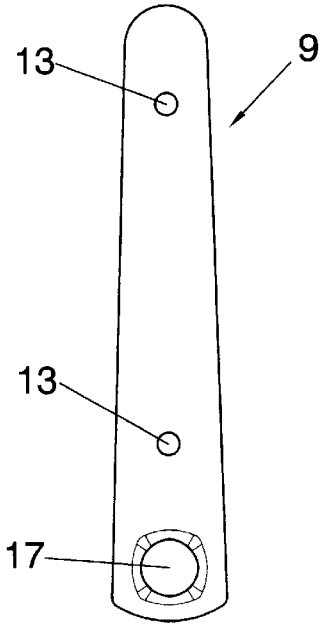
FIGS. 12, 13 and 14 show respective top plan, elevation and bottom plan, of the male securing plate.
Figure 13:
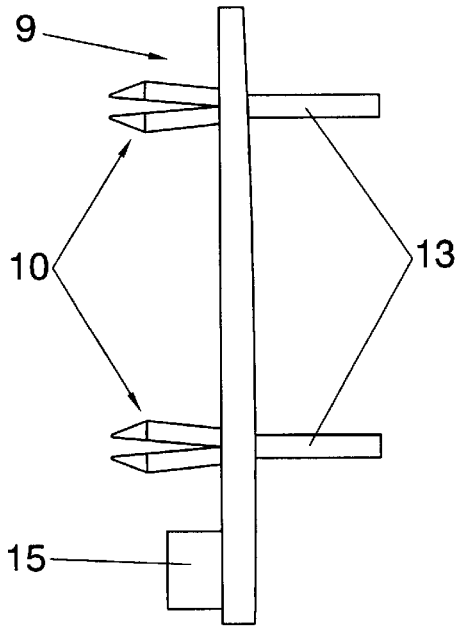

In FIGS. 8 and 9 can be see, referred to with number 18, the prismatic recess made in the bottom of the recess 7 of the grip 1 for receiving inside the projections 11 of the female plate 2. The male plate 9, as it has only the cylindrical nipples or pegs 10, it is only necessary for the floor of the recess 8 of the opposite face of the grip 1 to have the holes 19, as may be observed in FIGS. 4 and 9.

The grip 1 also has on its end corresponding to that of the handle, an internal thickening 27 (see FIG. 30) on each side, in which is made the pertinent hole 20 for insertion of the sockets 15 and 16 of the respective male 9 and female 2 plates. These thickenings have a contour which corresponds with that of the hole in the metal handle of the spanner, being perfectly fitted in order to achieve greater immobility of the grip.

On the other hand, as can be observed for example in FIGS. 14, 15, 20 and 22, the sockets 15, 16 can be provided with respective thickenings 15*a*, 16*a* which engage in the hole for hanging 26 of the handle 23 of the spanner.

Both the male plate 9 and the female plate 2 have in this example of embodiment shown in the figures and on their inside face, a perimeter skirt 21 very short in length, which is inserted in the channel 22 provided for this purpose in a position adjoining the wall of the recess 7 or 8 respectively.

As has been stated previously and in this example of preferred embodiment, the female plate 2 has its prismatic projections 11 constituted in the form of a bridge in which has been implemented the respective entry hole 12*a* of the pegs 2 having flexible extendible arms 14. In the area occupied by these bridges, the perimeter skirt 21 is interrupted, as is clearly seen from figures 24 and 25.

Figure 14:
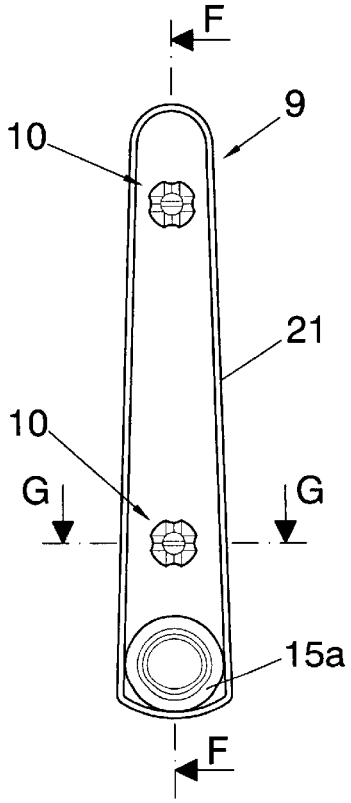
Figure 15:
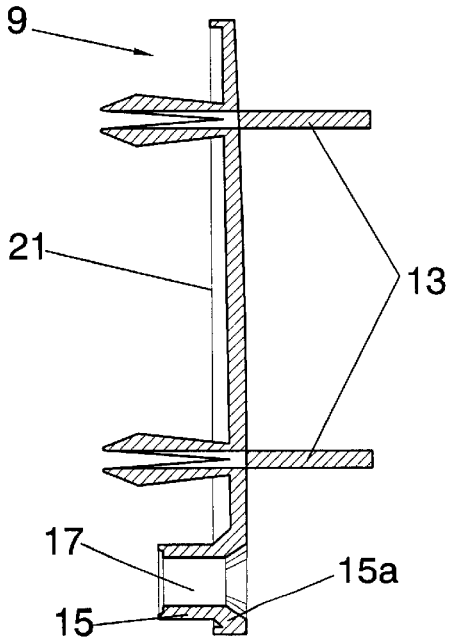
FIG. 15 shows a cross section on the line F—F of FIG. 14.
Figure 16:
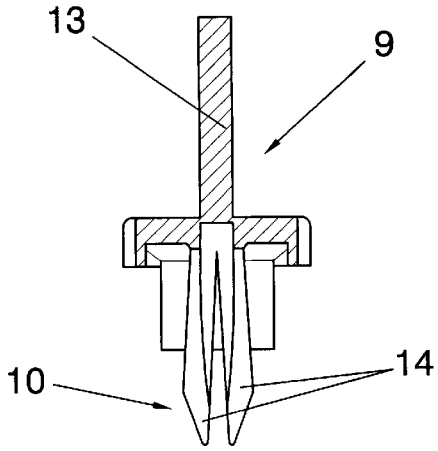
FIG. 16 shows a cross section on the line G—G of FIG. 14.
Figure 17:
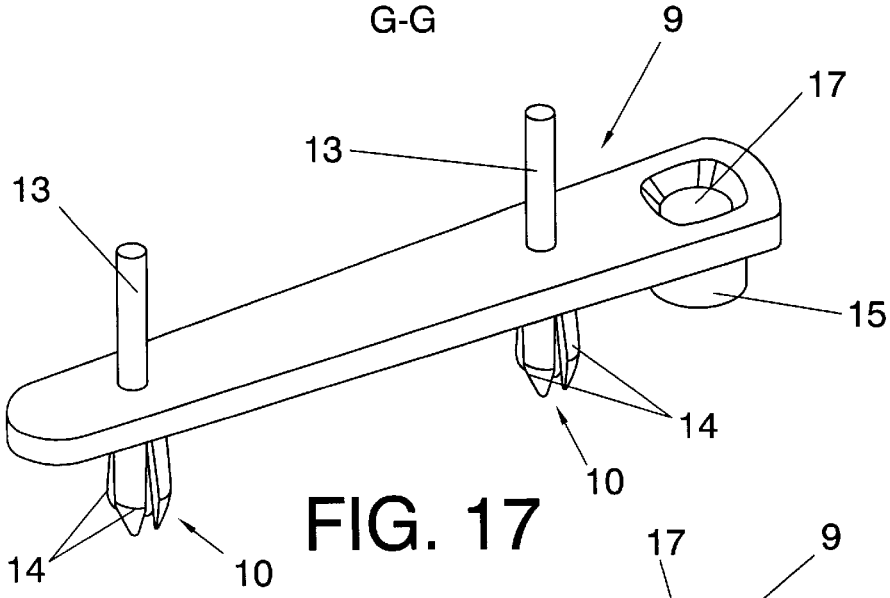
FIGS. 17 and 18 show respective views in perspective of the same male securing plate as in FIGS. 12 to 16, from two opposite sides.
Figure 18:
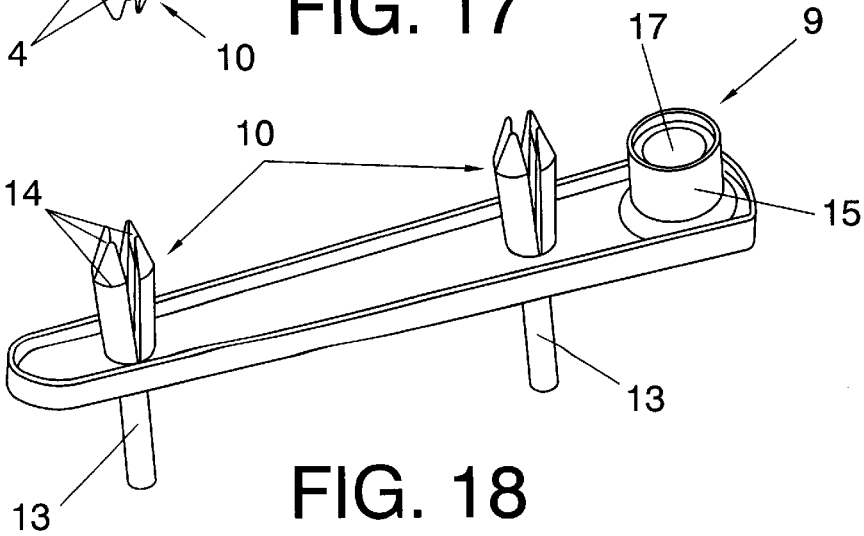
Figure 19:
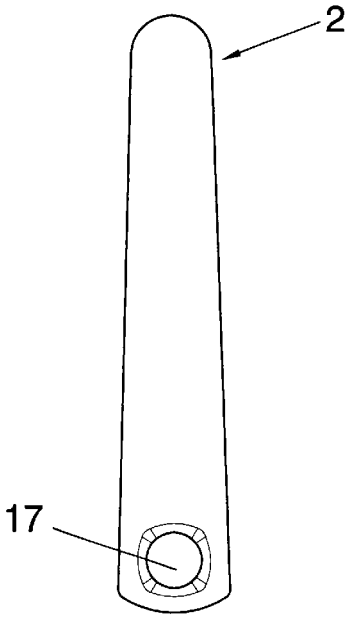
FIGS. 19, 20 and 21 show respective top plan, elevation and bottom plan, of the female securing plate.
Figure 20:
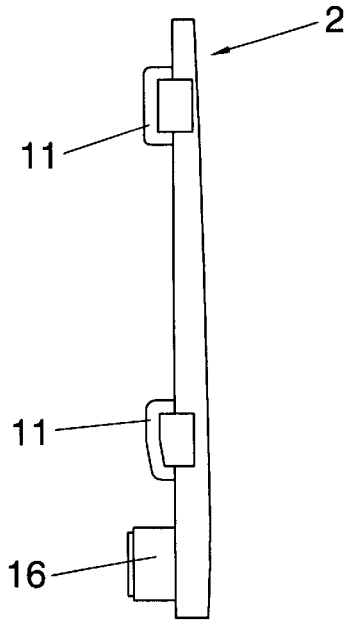
Figure 21:
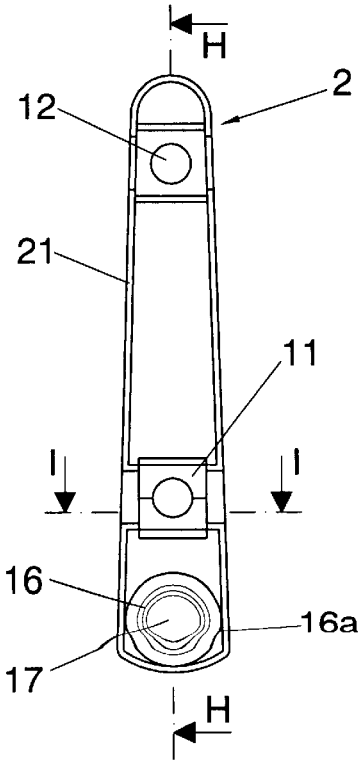
Figure 22:
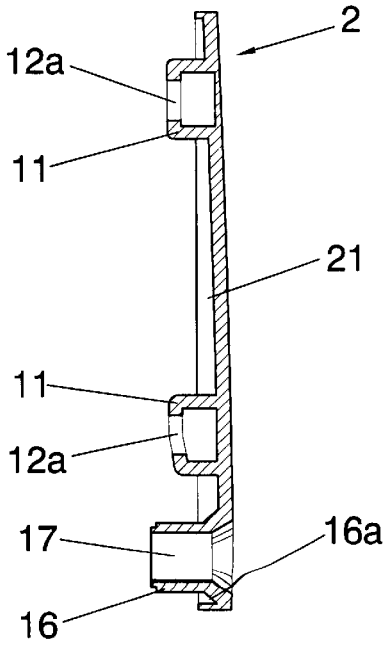
FIG. 22 shows a cross section on the line H—H of FIG. 21.
Figure 23:
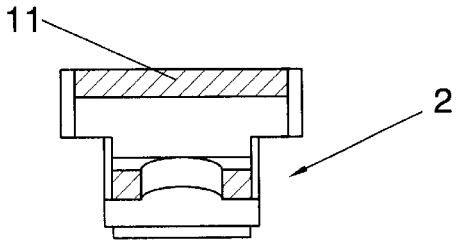
FIG. 23 shows a cross section on the line I—I of FIG. 21.
Figure 24:
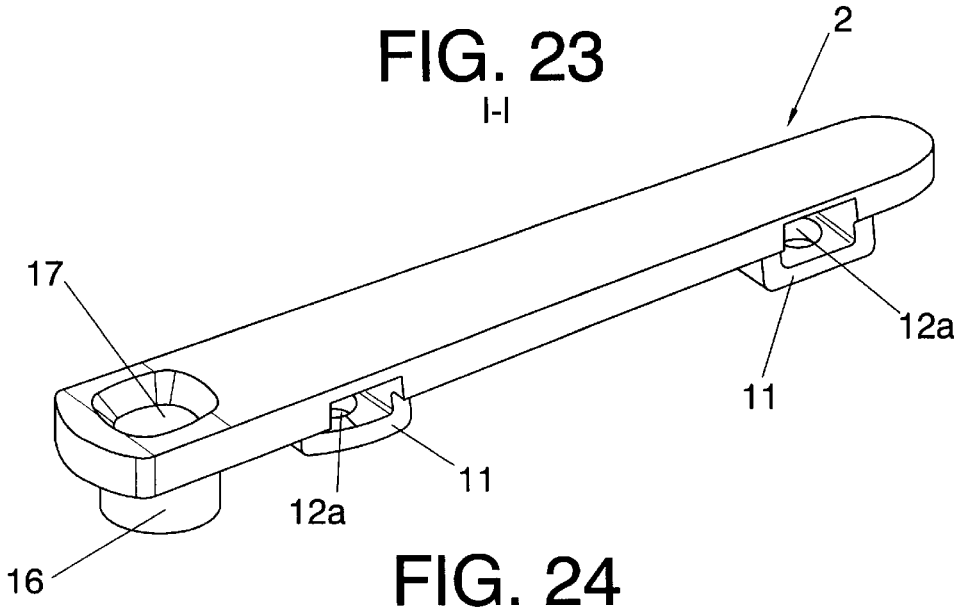
FIGS. 24 and 25 show respective views in perspective of the female securing plate, from two opposing sides thereof.
Figure 25:
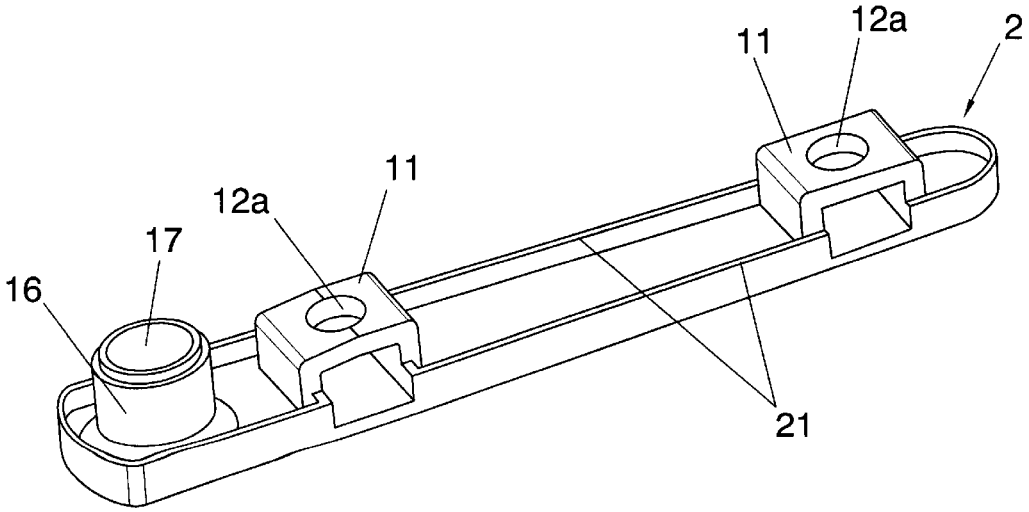
Figure 26:
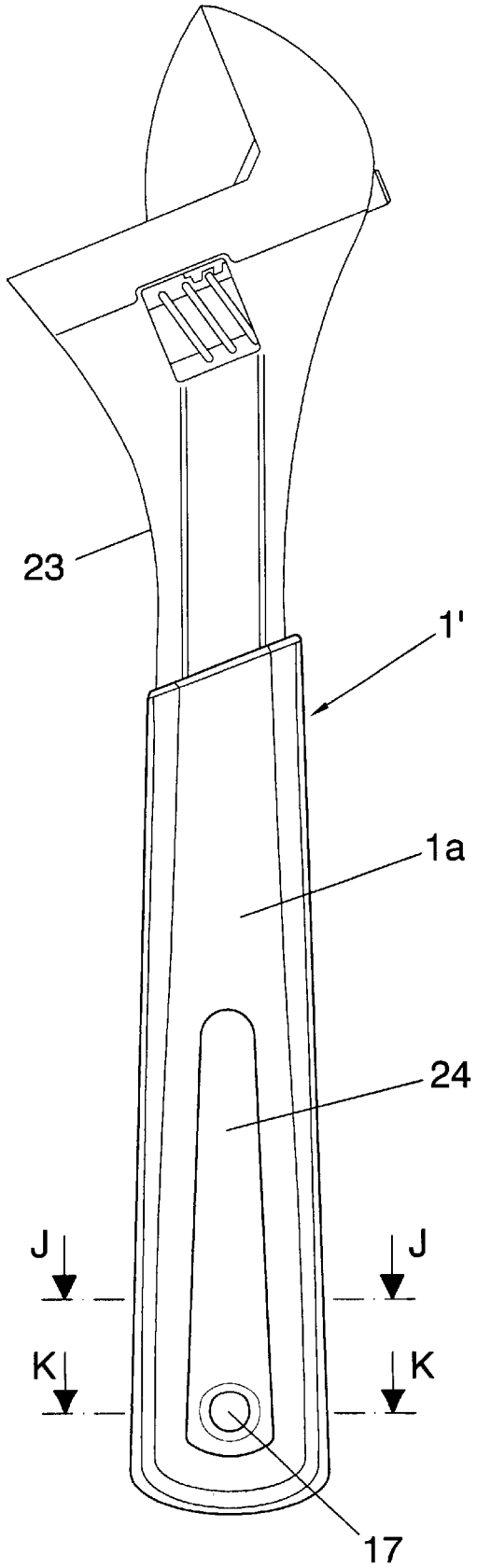
FIG. 26 shows a plan view of an adjustable spanner which has a replaceable grip which constitutes a second form of embodiment of the present invention.

Making now special reference to FIG. 16, in which the male plate 9 is seen in cross section on the line marked in FIG. 14, it can be observed how the solid pin 13 forms part of the actual material that constitutes the plate 9 and is joined to the mouth of the axial hole of the tubular configuration of the peg 10, being joined solely by an annular line easily fractured on striking the pin 13 in order to introduce it into the peg 10 at the end of the assembly operation.

With this disposition it can be understood that once the grip has been broken, it can be easily replaced once the original has been dismantled or destroyed, since the grip 1 can be easily introduced over the end of the metal handle of the adjustable spanner, afterwards proceeding with great ease to insert the male and female securing plates and finally embedding the solid pins 13.

The mechanical union between the plates 9 and 2, through the pegs 10 which are introduced into the holes 12 and the subsequent locking action, by the pins 13 which are introduced through the inside of the pegs 10, permits a union much superior to the traditional adhesive ones, whereby the grip can be replaced with ease.

On the other hand the male and female plates 9 and 2, define inscribable surfaces, for references, names, etc. with a greater degree of clarity, such that they permit an adequate personalisation of the product.

Now, making reference to FIGS. 26 to 32, an adjustable spanner can be seen according to another embodiment, in which the grip 1' also extends in like fashion over the length of the handle 23 and comprises a body 1*a* and an axial void 1*b* in the form of a double-tee. The grip 1' is consequently very similar to the grip 1 and is fabricated in a material which offers a high coefficient of friction, with an ergonomic shape very agreeable to hold.

Figure 27:
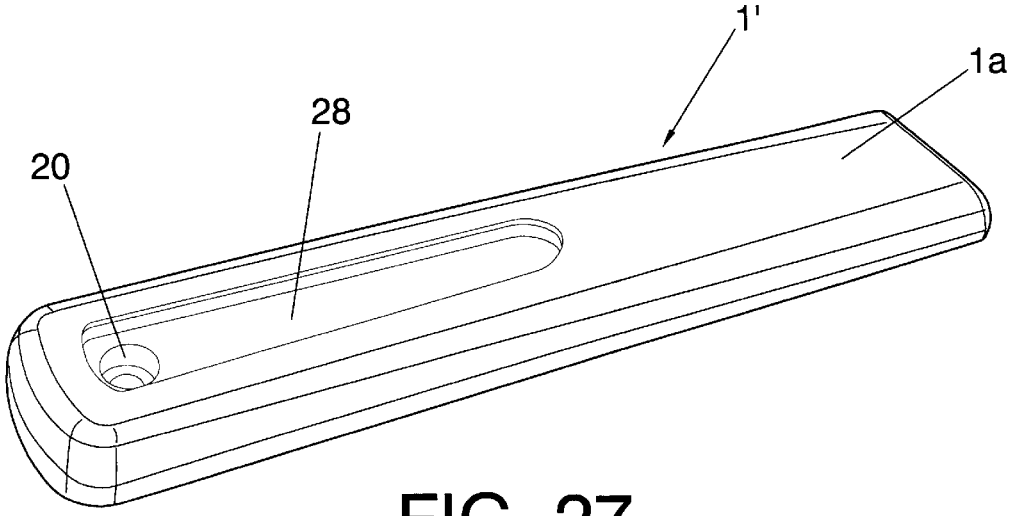
FIG. 27 shows a view in perspective of the same grip as FIG. 26.
Figure 28:
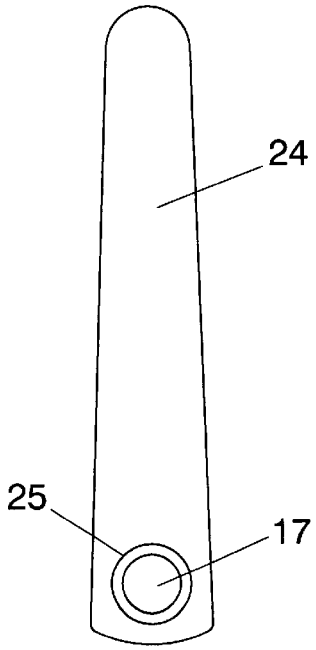
FIGS. 28 and 29 show respective plan and side elevation views of one of the securing plates of the second form of embodiment; elevation views of one of the securing plates of the second form of embodiment.
Figure 29:
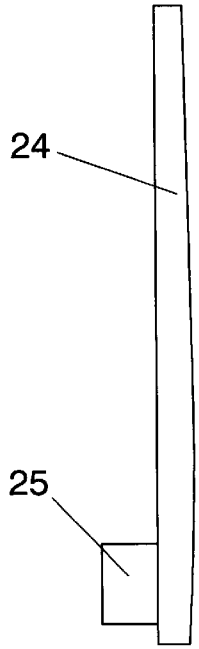

As can be seen more clearly in FIG. 27, the larger faces of the grip 1' have the longitudinal recesses with identical geometrical configuration and include the hole for hanging 20, the respective blocking plates 24 being fitted tightly in them, said plates being fabricated preferentially with stiff plastic and which in this case are identical, finishing advantageously flush with the exposed face of the grip 1'. One of the ends of the blocking plates 24 has the hollow cylindrical projection, or socket 25 intended to be inserted tightly into the respective opening 20 of the grip 1' (see FIGS. 30 and 32) coaxial with that for hanging the spanner, provided in the metal handle and referred to with number 26 (see FIG. 32).

The free ends of these sockets 25 do not actually come into contact in order to not produce the disagreeable effects mentioned previously, that is, they do not provoke rubbing and possible frictional noises, though they do manage to penetrate the metallic web of the handle 23 in order to optimise the blocking of the grip 1'.

Figure 30:
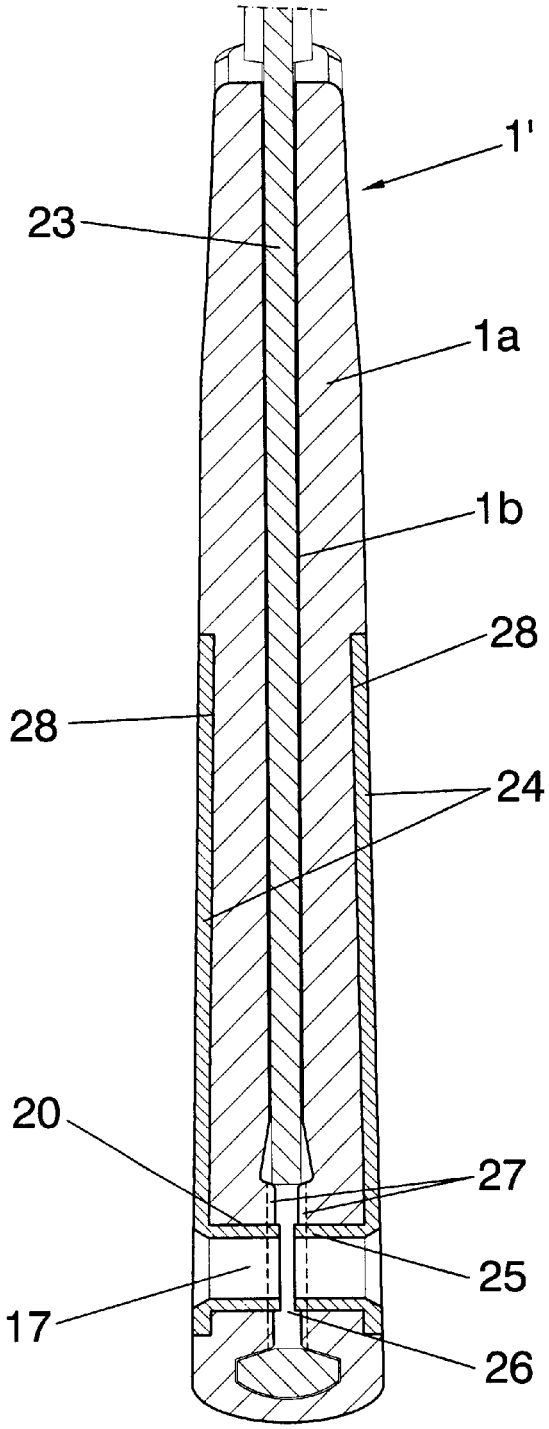
FIG. 30 shows a view in part longitudinal cross section of the handle of the adjustable spanner, including the replaceable grip and the securing plates, in accordance with this second form of embodiment.
Figure 31:
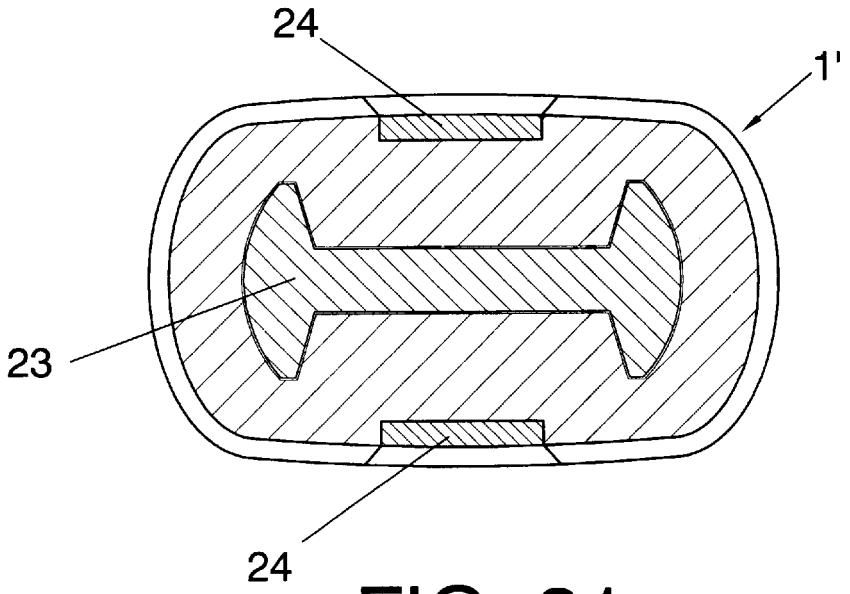
FIG. 31 shows a cross section on the line J—J of FIG. 26.
Figure 32:
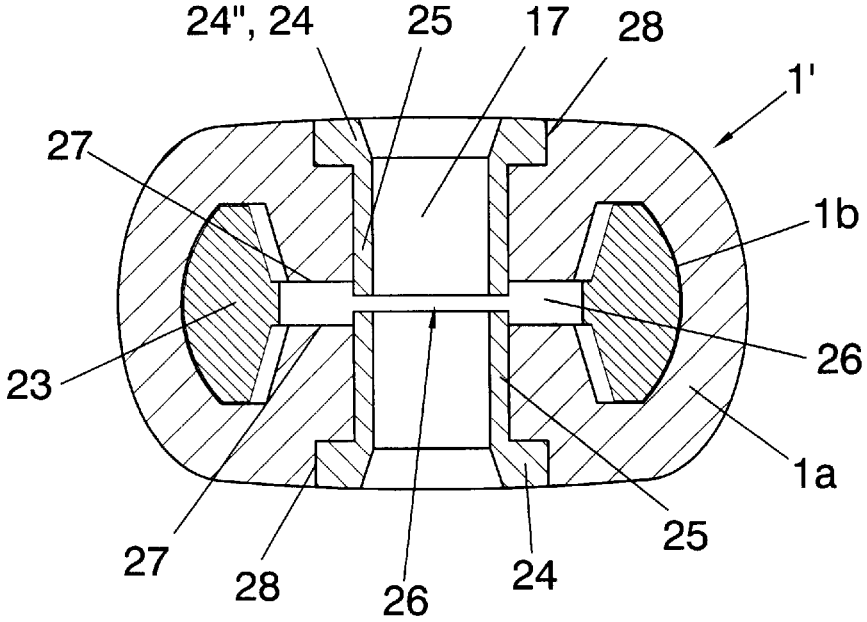
FIG. 32 shows a cross section on the line K—K of FIG. 26.

In FIGS. 30 to 32, the internal cross section of the grip 1' can be seen, adapted to that of the handle 23 which in this particular case is also tee-shaped, and also how the annular thickenings 27 or internal collars of the grip 1', analogous to those present on the other grip 1, progress towards the inside of the hole 26.

The plates 24 of stiff plastic are mounted after having impregnated with glue or adhesive, the walls and floor of the respective longitudinal recess, referred to with number 28.

Figure 33:
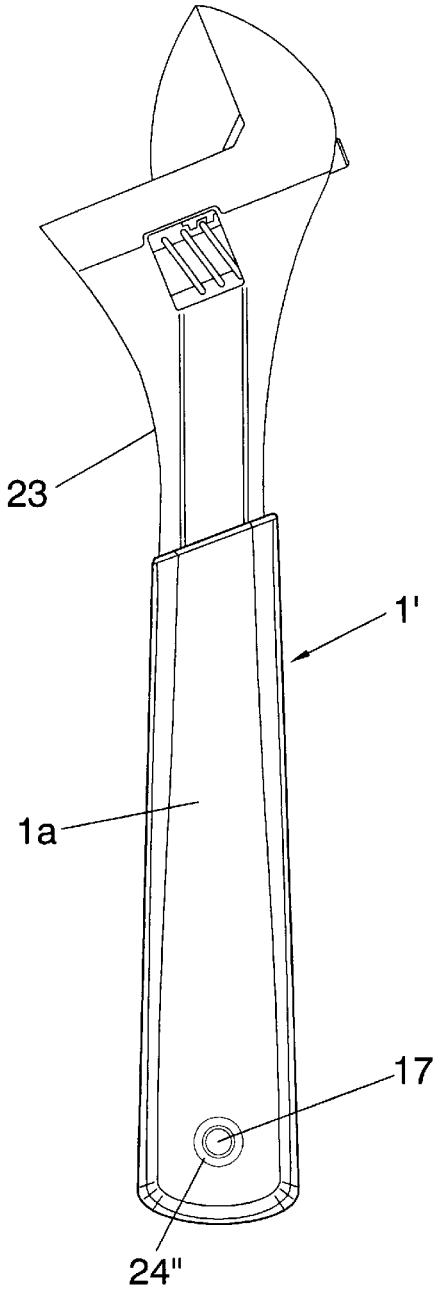
FIG. 33 shows a plan view of an adjustable spanner which incorporates a replaceable grip of different configuration with regard to the securing plates, with respect to the previous embodiments.
Figure 34:
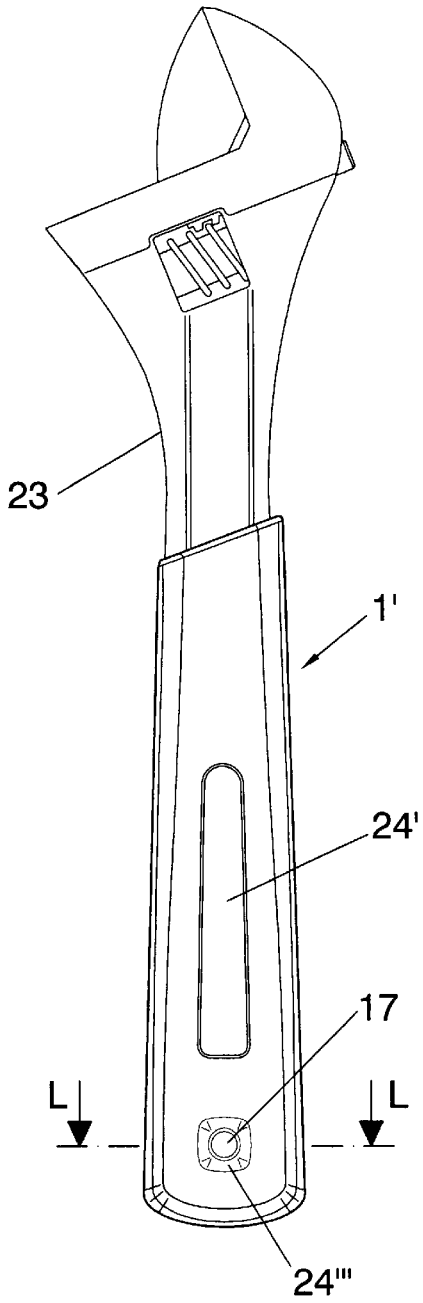
FIG. 34 shows a plan view of an adjustable spanner which shows a grip with another different configuration of the securing plates; and in accordance with the present invention.
Figure 35:
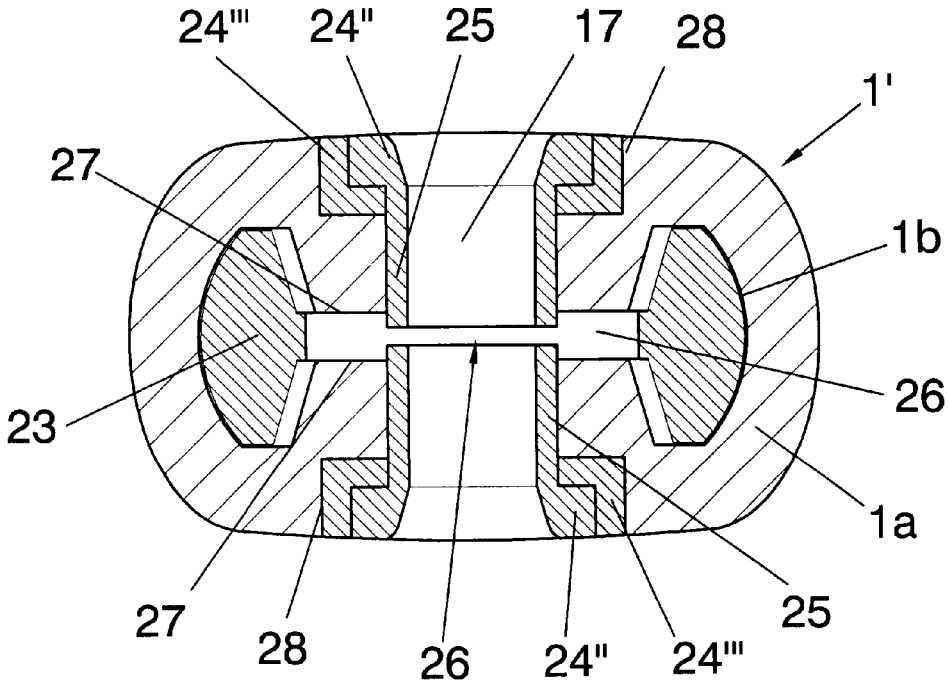
FIG. 35 shows a cross section on the line L—L of FIG. 34.

In the example of embodiment shown in FIGS. 26 to 32, the plates 24 and noticeably elongated, very similar to those with references 2 and 9 in the first form of embodiment, occupying in both cases a large part of the length of the respective grip 1 and 1', given that in addition to covering the area of the hole 20 for hanging the spanner 1, 1', they are extended towards the head in a longitudinal direction following the centre line. It is appreciated that such plates can be shorter in length, and even be limited to the external skirt 24" (see FIGS. 32 and 33) of the socket 25 or possibly, as may be appreciated in FIGS. 34 and 35, a washer 24'", see FIGS. 34 and 35.

The plates 24 as well as serving to stiffen by offering a great resistance to twisting of the grip 1', also provide like plates 2 and 9, for the incorporation of spanner information by having inscribed thereon references, names, etc., with a higher degree of definition than is customary, permitting an adequate personalisation of the product. In the event that the plates be limited solely to the area surrounding the hole 20 for hanging, that is when dealing with the above mentioned washers 24'", the data and references of the spanner can be located, either on the grip 1' itself or on other independent plates 24', as may be seen in FIG. 34.

In any of the foregoing solutions provision has been made for the grip 1 or 1' to include recesses 7, 8, 28 on both side faces in order to effect the fitting of the pertinent stiffening plates 2, 9, 24, washers 24'" and/or personalisation plates 24', however the grip can equally have recesses on one face only, though in these cases the length of the socket 25 of the plate 24 shall have to be somewhat greater than in the previous cases in order to optimise the blocking of the grip, or come with the washer 24'".

The grip 1' is structured in such a manner that there is no contact between rigid elements. It can be seen in the figures that there is no contact between the sockets 25 of the plates 24 in stiff plastic. Nor is there contact between the plates 24 and the metal handle 23 by being separated by the grip itself of thermoplastic material, rubber or similar.

The grip 1' can be applied to any kind of adjustable spanner independently of the shape of the handle, the blind axial void having a cross section adapted to that which the handle has, at all points thereof. This grip can even be mounted on spanners already existing and being employed by the user.

in the event that it be necessary to replace one grip with another, the procedure is to extract or separate the plastic plates 24 from the grip 1' to be replaced, or else proceed with a "peeling", operation which consists in making a lateral or longitudinal cut from top to bottom of the grip, which permits it to be opened to release the ends of the sockets 25 of said plates 24, with respect to the hole 26 of the handle 23.

Preferentially the union between the plates 24 and the grip 1' shall be implemented by means of glue or adhesive, however other systems may be foreseen like fitting together by dovetail sections, etc.

What is claimed is:

1. Replaceable grip for a handle of a spanner, particularly of an adjustable spanner, with a handle provided at a first end with a hole for hanging, the grip comprising a body open at one of its ends, of an at least semi-flexible material selected among plastic materials, thermoplastic materials and rubbers, adapted internally to at least part of a section of the handle and securing means in order to fix the body to the handle, wherein the body of the grip comprises:

a blind internal axial void having a double-"T" cross section adapted to the cross section of the handle at different points of a contour of the handle, a through-hole in a position coincident with the hole for hanging of the handle of the spanner and surrounded by an annular thickening at each internal side of the body of the grip, said annular thickenings projecting inwards and fitting inside the hole for hanging of the handle of the spanner, in order to achieve a better immobility of the grip;

the securing means comprise:

flat blocking elements covering at least the opposing rims of said through-hole, securing means provided with a hollow cylinder projecting inwards and fitting inside the through-hole of the grip, keeping free the hole for hanging, and tightening the blocking elements against the grip by means of a retention by pressure in said hole for hanging.

2. Replaceable grip, according to claim 1, wherein the blocking elements are joined to the grip by means of an adhesive.

3. Replaceable grip, according to claim 1, wherein the blocking elements are each mounted in axial recesses provided on each side of the body, the through-hole being arranged in said recesses.

4. Replaceable grip, according to claim 1 wherein at least one of the blocking elements is a blocking plate mounted axially in the grip.

5. Replaceable grip, according to claim 1, wherein at least one of the blocking elements is an outside edge of a socket.

6. Replaceable grip, according to claim 1, wherein at least one of the blocking elements is a blocking washer.

7. Grip, according to claim 1, wherein the securing means which tighten the blocking elements against the grip comprise a male socket and a female socket coupled to each other in the hole for hanging.

8. Grip, according to claim 7, wherein the blocking elements comprise a male plate from which emerges the male socket and a female plate from which emerges the female socket.

9. Grip, according to claim 1 wherein at least one of the securing means which tighten the blocking elements against the grip comprise a socket which emerges from a blocking plate, the socket being restrained in the hole for hanging.

10. Replaceable grip, according to claim 7 wherein the sockets each have free edges with male-female interconnection means.

11. Replaceable grip, according to claim 7, wherein the sockets are provided with thickenings which fit in the hole for hanging of the handle of the spanner.

12. Replaceable grip, according to claim 10, wherein the thickenings emerge respectively from the male plate and the female plate.

13. Replaceable grip, according to claim 4, wherein the at least one of the blocking elements are at least two plates which are joined to each other by means of male-female elements passing through at least one supplementary hole provided on the handle of the spanner.

14. Replaceable grip, according to claim 13, wherein one of the blocking plates of the grip is a male plate, has an elongated shape and incorporates at least one peg with diametrical cuts which form elastic arms passing through an additional hole of the grip and through the additional hole in the handle of the spanner.

15. Replaceable grip, according to claim 14, wherein one of the plates is a female plate which has on its inside face at least one projection provided with a receiving hole which receives the elastic arms of the male plate.

16. Replaceable grip, according to claim 15, wherein both plates are integral to each other, once mounted on the respective face of the grip, by means of complementary means of axial fastening, with which the elastic arms of the male plate are expanded.

17. Replaceable grip, according to claim 16, wherein the complementary means of axial fastening comprise a solid pin housed in an axial void of the peg, the pin expanding the flexible arms.

18. Replaceable grip, according to claim 17, wherein the solid pin emerges from the male plate.

19. Replaceable grip, according to claim 15, wherein a free edge of the male and female plates, has a perimetric skirt which defines a lip that is inserted in a channel in the bottom of the longitudinal recess of the grip.

20. Replaceable grip, according to claim 15, wherein the projection of the female plate, has a bridge shape.

21. Replaceable grip, according to claim 1 wherein it has ribs and protuberances to provide a non-slip function.

* * * * *